US005690042A

United States Patent [19]

Bentley

[11] Patent Number: 5,690,042

[45] Date of Patent: Nov. 25, 1997

[54] MOORING DEVICE AND SECURING DEVICE FOR WATERCRAFT AND METHODS OF MAKING THE SAME

[76] Inventor: Darrell G. Bentley, P.O. Box 609, Licking, Mo. 65542

[21] Appl. No.: 723,383

[22] Filed: Sep. 30, 1996

Related U.S. Application Data

[63] Continuation-in-part of Ser. No. 544,972, Mar. 3, 1996, abandoned.

[51] Int. Cl.[6] ..... B63B 21/00

[52] U.S. Cl. ..... 114/230; 114/218; 410/116; 70/18

[58] Field of Search ..... 114/218, 230; 410/116; 70/2, 59, 60, 18, 14, DIG. 57; 248/495; 411/551–553

[56] References Cited

U.S. PATENT DOCUMENTS

| | | | |
|---|---|---|---|
| 1,516,489 | 11/1924 | Barton | 248/499 |
| 3,169,293 | 2/1965 | Neuschute | 411/552 |
| 4,297,963 | 11/1981 | Beacom | 114/230 |
| 4,545,897 | 10/1985 | Verdenne et al. | 411/552 |
| 4,630,982 | 12/1986 | Fenner | 248/499 |
| 4,657,462 | 4/1987 | Hoen | 411/552 |
| 4,793,163 | 12/1988 | MacFarlane et al. | 70/2 |
| 4,873,848 | 10/1989 | Honeyman, III | 70/14 |
| 5,123,795 | 6/1992 | Engel et al. | 411/553 |
| 5,381,685 | 1/1995 | Carl et al. | 70/14 |
| 5,456,443 | 10/1995 | Taaffe | 248/499 |
| 5,467,617 | 11/1995 | Huebner | 70/2 |

FOREIGN PATENT DOCUMENTS

| | | | |
|---|---|---|---|
| 659257 | 10/1951 | United Kingdom | 70/2 |

OTHER PUBLICATIONS

Portable Docking Ring, 20–583–863–00, Bass Pro Shops 1996 Marine catalog, p. 80.

*Primary Examiner*—Jesus D. Sotelo
*Attorney, Agent, or Firm*—Richard L. Marsh

[57] ABSTRACT

A mooring device adapted for removably attaching a watercraft to a dock is provided. The mooring device comprises an upright pivot shaft having a T-shaped handle on one end and a T-shaped locking bar on the other end. A biasing spring, clevis and tension plate are also mounted on the shaft intermediate the ends, with the T-shaped locking bar being rigidly affixed to the end of the pivot shaft. The tension plate is biased toward the T-shaped locking bar by the biasing spring, with the biasing spring bearing against one side of a support affixed to the upright pivot shaft. One arm of the clevis rests against an opposite side of the support with the other arm of said clevis spaced from the T-shaped handle. The T-shaped handle is firmly affixed to the end of said upright pivot shaft opposite the end having the T-shaped locking bar. The shaft of the mooring device has a locking element associated therewith for lockably attaching the mooring device to the docking platform.

20 Claims, 5 Drawing Sheets

MOORING DEVICE AND SECURING DEVICE FOR WATERCRAFT AND METHODS OF MAKING THE SAME

CROSS REFERENCE TO RELATED APPLICATIONS

This application is a continuation-in-part application of its parent patent application Ser. No. 08/544,972 filed Mar. 3, 1996 now abandoned.

BACKGROUND OF THE INVENTION

1. Field of the Invention

This invention relates to a mooring device adapted for removably mooring a watercraft to a dock. The mooring device is a spring-loaded fastener requiring only a quarter turn to move from a fastening position to a release position. The mooring device utilizes a lockable assembly affixed thereto and carried thereby for lockably securing the watercraft to the dock.

2. Prior Art Statement

When a watercraft owner desires to moor a watercraft to a dock, it is customary to secure a lanyard to a cleat on both the dock and the boat by lacing the opposite ends of the lanyard around the respective cleats in a figure eight fashion. Such a mooring is temporary in nature and does not prevent theft of the watercraft as it is easy to remove the lanyard from either the dock or the boat. For a more secure docking of a watercraft, the craft may be raised from the water on a boat lift but such docking is cumbersome and generally available only at the home location of the boat or a marina equipped with boat lifts. Therefore, a mooring device adapted for removably mooring a watercraft to a dock having a spring-loaded fastener requiting only a quarter turn to move from a fastening position to a release position and utilizing a lockable assembly affixed thereto and carried thereby is desired for lockably securing a watercraft to any dock.

It is known to provide a portable docking ring for temporarily mooring a watercraft to a dock having spaced apart dock planks. For instance, see the item 20-583-863-00, Portable Docking Ring, available from Bass Pro Shops, Springfield Mo. as shown in Bass Pro Shops 1996 Marine catalog, page 80.

It is also known to utilize a mooring device for temporarily mooring a watercraft to a dock having spaced apart dock planks wherein the mooring device has a rigid T-bar form body with an elongated head secured transversely to one end of a shaft, a flat plate mounted on the shaft with a biasing means associated therewith to bias the plate toward the shaft. For instance, see the U.S. Pat. No. 4,297,963 issued on Nov. 3, 1981 to Keith Beacom.

It is further known to provide a device for securing valuables such as a boat wherein the device has a U-shaped hasp with an eye at one end of one of the legs for attaching chains, cables or the like with both legs of the hasp having a slot therethrough for receiving a latch lug pivoted to one of the legs. For instance, see U.S. Pat. No. 4,873,848 issued on Oct. 17, 1989 to Henry Honeyman, III.

Finally, it is well known to provide an eye in each of two elements for securing the elements together with a padlock such as is used in a common door or trunk hasp.

SUMMARY OF THE INVENTION

The above mentioned means of mooring watercraft to docks either do not have a means to lockably secure the mooring device to the dock or need to utilize a cleat or eye fixed to the dock. Therefore, it is essential to provide locking means associated with a mooring device and more particularly with a plate of a mooring device for lockably attaching the mooring device to the docking platform.

The mooring device of this invention, or DOC-LOC, works on the principle of a spring clamp with a 90 degree twist that will release on a 90 degree min. Sizes from ⅜ inch to 6 inch are to be used primarily as an anchoring device to suitable wood, steel, concrete or any size acceptable platforms or objects.

The mooring device, or DOC-LOC, comprises a plastic bar handle approximately 1.6 inches in width by 3.5 inches in length; a diamond braided polyethylene rope of suitable length, a hexagonal nut, an anchor shackle clevis adapted to receive the rope, a spring approximately 2.75 inches in free length with a wire diameter of 0.06 inches and an internal spring diameter of one half (0.5) inches, a tension plate approximately one-eighth inch thick by 2.75 inches in diameter, a stainless steel locking bar approximately 3 inches in length by three eighths inch in diameter, a stainless steel rod approximately 6.5 inches long by three eighths inch in diameter with threads on one end, two sixty (60) ton swaging and a fillet weld.

The bar handle is a plastic or steel handle used for compressing the spring against the tension plate and turning the locking bar.

The hexagonal nut is attached to the stainless steel rod on the threading as a locking nut for the bar handle. Directly under the hexagonal nut is the anchor shackle clevis used for attaching the diamond braided polyethylene anchoring rope. Under the anchor shackle clevis on the stainless steel rod is a sixty (60) ton swaging used to retain the anchor shackle clevis and the spring in place. Also fitted on the stainless steel rod under the swaging is the spring used to apply downward pressure on the tension plate. Directly beneath the tension plate is another sixty (60) ton swaging used to hold the tension plate in place on the stainless steel rod above the locking bar. The locking bar is attached to the stainless steel rod by a fillet weld.

When downward pressure is applied to the bar handle and a 90 degree right or left turn is applied, the locking bar will turn and be in a horizontal alignment with the insertion point on the platform of which it has been inserted. When downward pressure is removed from the bar handle, then the spring will apply upward pressure pulling the locking bar into contact with an anchoring platform.

The anchor shackle clevis is attached to the stainless steel rod as a point of attachment for the rope that will be attached to the object or vehicle being anchored.

It is an object of this invention to provide a mooring device adapted for lockably attaching a watercraft to a docking platform.

It is another object of this invention to construct a mooring device comprising an upright pivot shaft having a T-shaped handle at one end thereof, a T-shaped locking bar at the other end thereof, a biasing spring, clevis and tension plate intermediate the ends, the T-shaped locking bar being rigidly affixed to said the end of said pivot shaft, the tension plate being biased toward the T-shaped locking bar by the biasing spring and the mooring device having a locking means integral therewith and carried thereby.

It is yet another object of this invention to provide a mooring device having a T-shaped locking bar which is adapted to be inserted m the slot formed between adjacent planks on a dock and be locked thereon.

It is still another object of this invention to provide a mooring device wherein a tension plate overlies the slot between adjacent planks on a dock and has locking means integral therewith and carded thereby.

It is another object of this invention to provide a mooring device wherein a locking means is disposed in a slot on one side of the tension plate of the mooring device.

It is another object of this invention to provide a mooring device wherein a locking means is disposed in a hole through the shaft adjacent the tension plate of the mooring device.

It is another object of this invention to provide a mooring device wherein multiple holes through the shaft disposed one above the other provides means to lockably attach the mooring device to docks having, lock boards of differing thickness.

It is another object of this invention to provide a mooring device wherein a locking means is disposed in a second hole formed in the tension plate from at least one peripheral edge of the tension plate and extends into a first hole adapted to receive the shaft therein, the second hole being formed in the tension plate in a plane perpendicular to the first hole.

It is yet another object of this invention to provide a mooring device adapted for mooring a craft to a docking platform having spaced decking elements of uniform thickness, the mooring device having a means for securing a line thereto and comprising having a shaft with an elongated head secured transversely to one end thereof wherein the head is sufficiently narrow to fit between the decking elements and wherein the mooring device has locking means integral therewith and carrier upon the shaft for lockably attaching the mooring device to the docking platform.

Furthermore, it is an object of this invention to provide a mooring device wherein a T-shaped handle is utilized to press a tension plate onto adjacent planks, displace a T-shaped locking bar below a bottom side of adjacent planks, rotate the T-shaped locking bar substantially ninety degrees in the slot thereby capturing the adjacent planks between the tension plate and the T-shaped locking bar upon release thereof and having locking means thereon for lockably attaching a watercraft to a docking platform.

Finally, it is an object of this invention to provide a method of making a mooring device having a T-shaped handle utilized to press a tension plate onto adjacent planks, displace a T-shaped locking bar below a bottom side of adjacent planks, rotate the T-shaped locking bar substantially ninety degrees in the slot thereby capturing the adjacent planks between the tension plate and the T-shaped locking bar upon release thereof and having locking means thereon for lockably attaching a watercraft to a docking platform.

DESCRIPTION OF THE PREFERRED EMBODIMENTS

While the various features of this invention are hereinafter described and illustrated as a device to moor a watercraft to a dock, and particularly, to lockably secure a watercraft to a dock, it is to be understood that the various features of this invention can be used singly or in various combinations thereof to provide for mooring of other objects to other locations as can hereinafter be appreciated from a reading of the following description.

Figure 1:
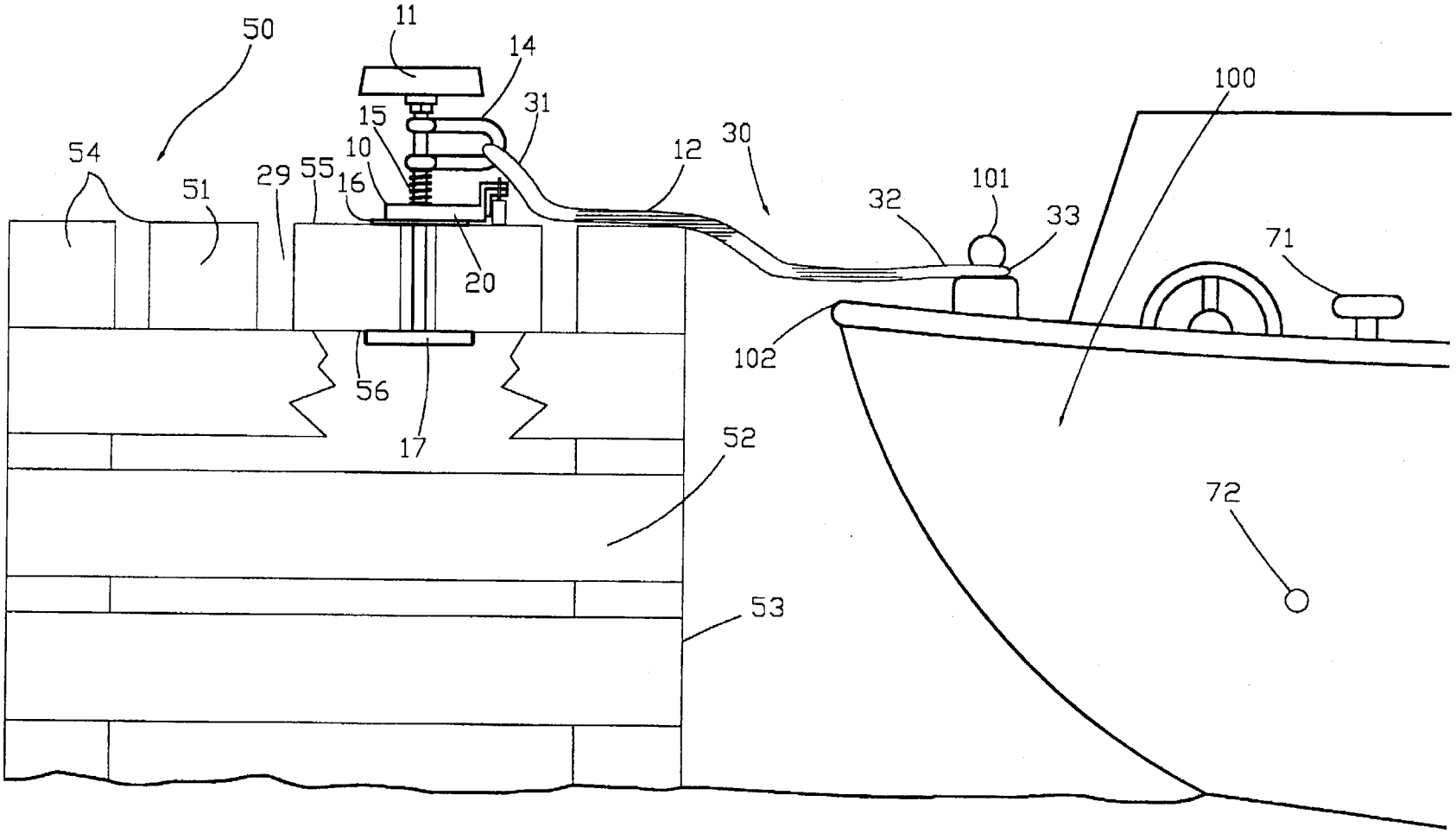
FIG. 1 is a view of a watercraft moored to a dock utilizing the mooring device and locking means assembly of this invention.

Referring now to FIG. 1, a watercraft 100 is moored alongside a dock 50 utilizing the mooring device 10 of this invention. A portion of mooring device 10 is adapted to be placed between adjacent dock boards 54 of the deck 51, vertical side walls 52 or end 53 of dock 50. Mooring device 10 may be utilized by a watercraft owner wherein mooring device 10 is permanently attached to one end 31 of a lanyard 30 having an eye 32 in the free end 33 thereof. For temporarily mooring watercraft to any dock, eye 32 of lanyard 30 is looped around a cleat 101 on the gunwale 102 of watercraft 100 and mooring device 10 is placed between two adjacent dock boards 54 on a dock 50 visited by watercraft 100. An exact location of either mooring device 10 or watercraft 100 is no longer necessary as mooring device 10 may be placed between any two adjacent dock boards 54 as is readily apparent from FIG. 1.

Figure 2:
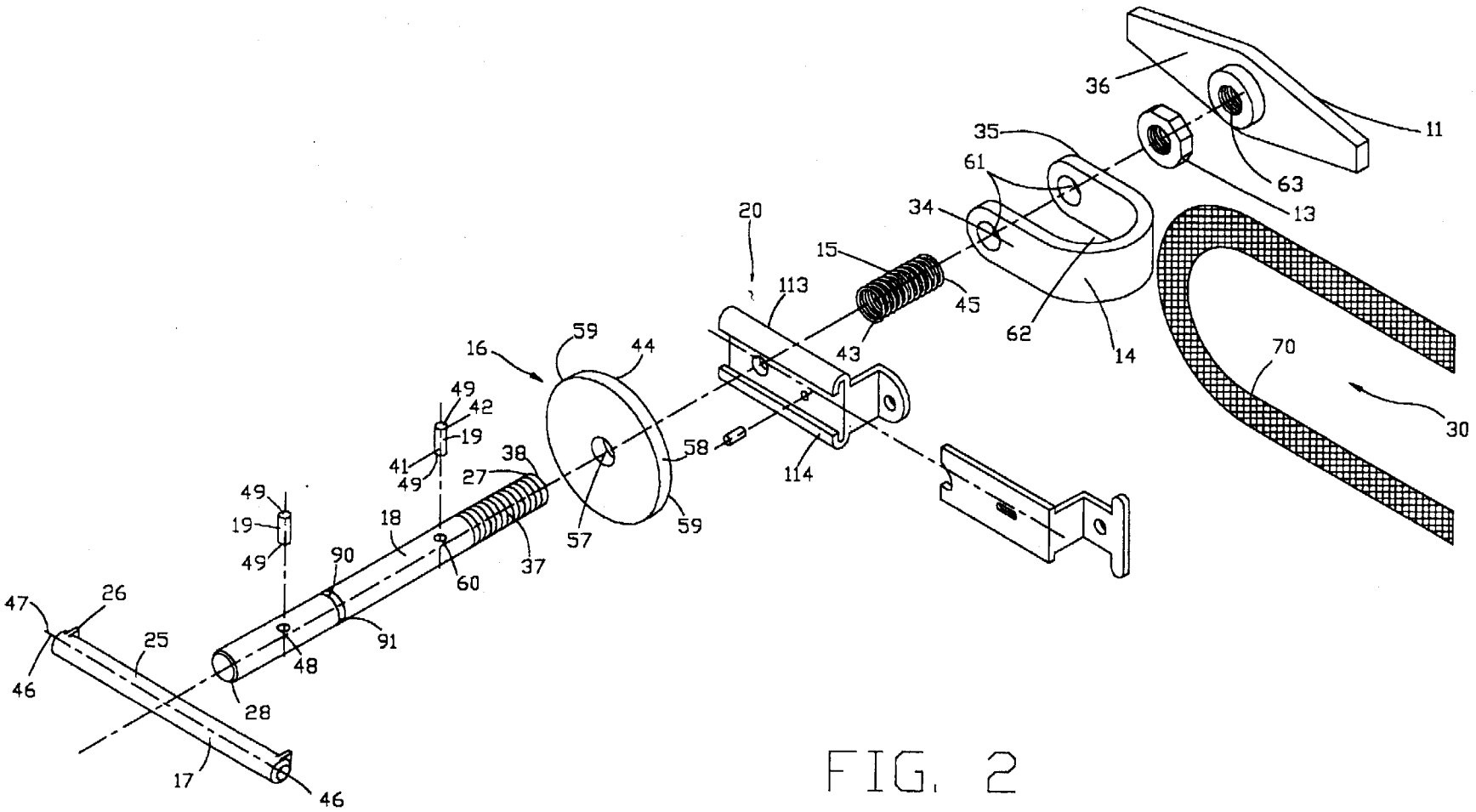
FIG. 2 is an exploded perspective view of the working elements of the preferred embodiment of the mooring device having a locking means mounted thereon.
Figure 4:
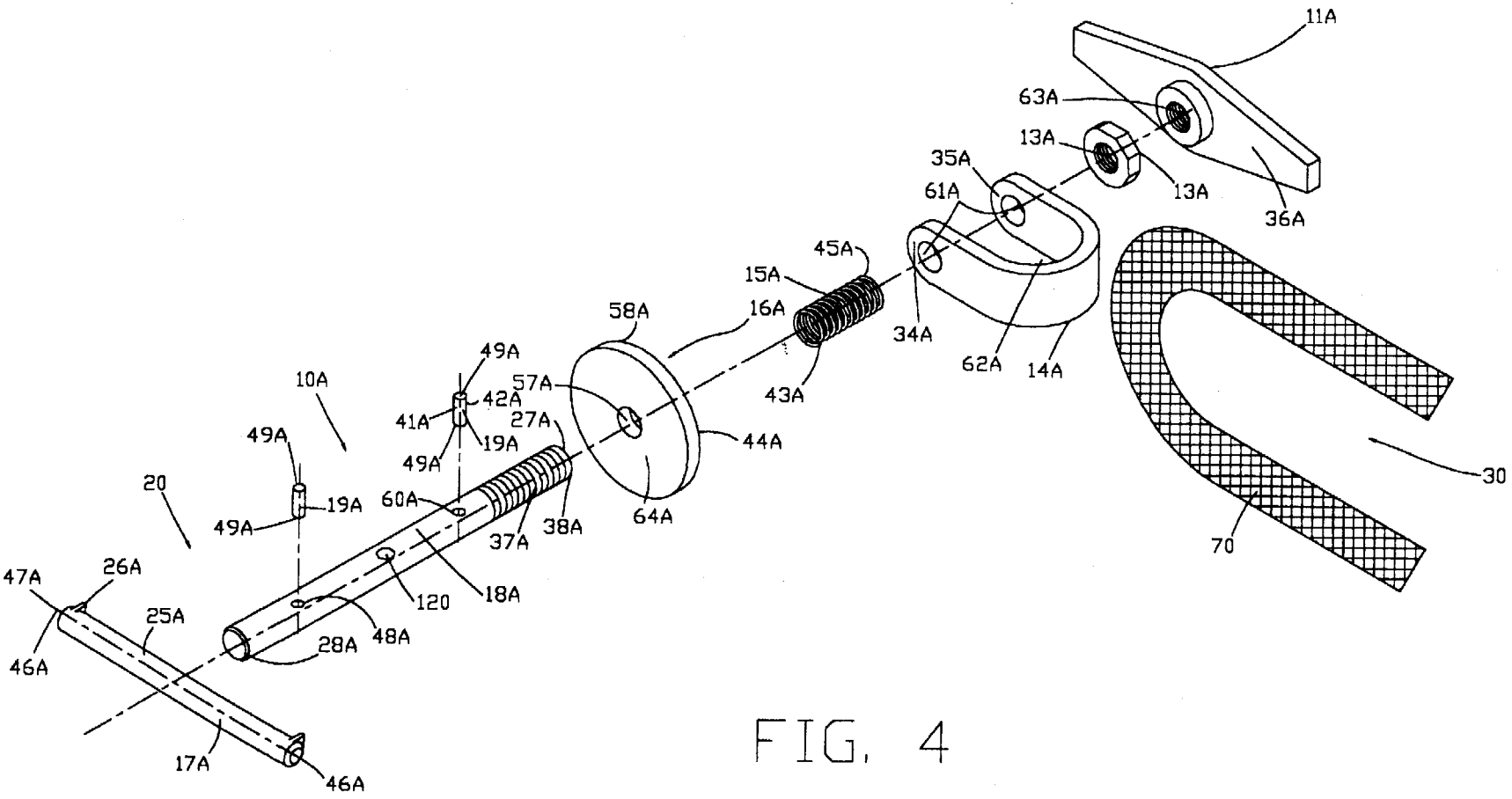
FIG. 4 is an exploded perspective view of the working elements of an alternative embodiment of the mooring device of this invention having a locking means disposed in the shaft thereof.

Similarly, a dock owner may employ at least one mooring device 10 for each watercraft 100 desiring mooring to the owner's dock by placing mooring device 10 between any two adjacent dock boards 54 and passing eye 32 of lanyard 30 to the watercraft 100 desiring mooring. In this manner, cleats (not shown) normally attached to docks 50 may be removed providing a smoother exposed surface 55 on deck 51 thereby removing a potential safety hazard from dock 50. Upon detaching a watercraft 100 from his dock 50, the dock owner may secure mooring devices 10 in secure locations within the service bay thereby preventing theft of mooring devices 10 from dock 50. Normally, lanyard 30 will comprise a common twisted fiber mooring rope 12 which a watercraft owner or dock owner may use for temporarily mooring watercraft 100 to docks 50, however, lanyard 30 may also be a steel cable or chain as hereinafter described. Mooring device 10 may be as shown in FIGS. 1, 2 and 4 but may also be the device shown in U.S. Pat. No. 4,297,963, now incorporated into this specification by this reference thereto or may be the portable docking ring now marketed by Bass Pro Shops as described above, each of the above modified according to the teachings of this invention to accept a locking means 20 thereon.

In the preferred embodiment, mooring device 10 is best utilized in combination with locking means 20, hereinafter described, for lockably securing the mooring device and hence the watercraft 100 to dock 50. When lockably securing a watercraft 100 to dock 50, lanyard 30 will usually comprise a chain similar to the chain shown in U.S. Pat. No. 4,873,848 or a steel cable 70 as shown in FIG. 2 permanently affixed to watercraft 100 and to mooring device 10.

To secure a watercraft 100 to dock 50, locking T-bar 17 is placed between two adjacent dock boards 54 and T-handle 11 of mooring device 10 is depressed engaging tension plate 16 against the exposed surface 55 of dock boards 54 and moving locking bar 17 to a position below the opposite surface 56 of dock boards 54. T-handle 11 is then rotated through an angular amount, usually about ninety degrees, sufficient to move locking bar 17 to a position approximately perpendicular to dock boards 54. Upon releasing T-handle 11, the upper surface 25 of locking T-bar 17 engages the opposite surface 56 of dock boards 54 with biasing spring 15 firmly pressing tension plate 16 against exposed surface 55. As best seen in FIG. 2, upper surface 25 of locking T-bar 17 may have engaging spikes 26 projecting therefrom adapted to bite into opposite surface 56 of dock boards 54 to provide positive engagement thereby preventing rotational movement of locking bar 17.

In a similar manner, a dock owner may have at least one mooring device 10 with a chain or steel cable as described above affixed to an anchor clevis 14 and having the hasp as described and claimed in U.S. Pat. No. 4,873,848, now fully incorporated into this application by this reference thereto, attached to the other end of the chain or steel cable for docking locations where overnight or semi-permanent mooring of watercraft 100 is desired. The bight of the hasp may be padlocked to a lifting eye 71 or towing eye 72 of the watercraft 100 as described in the aforementioned U.S. Pat. No. 4,873,848 with mooring device 10 being subsequently locked onto dock 50 according to the teachings of this invention. In this manner, a dock owner has control of mooring devices 10 and maintains control of the responsibility of secure overnight or semi-permanent moorings of watercraft 100 under his control.

Referring again to FIG. 2, the preferred embodiment of the mooring device 10 of this invention 10 comprises an upright pivot shaft 18 having a T-shaped handle 11 at one end 27 thereof, a T-shaped locking bar 17 at the other end 28 thereof, and a clevis 14, a biasing spring 15, a locking means 20 and a tension plate 16 disposed about shaft 18 intermediate ends 27 and 28. T-shaped locking bar 17 is rigidly affixed to other end 28 of shaft 18, with locking means 20 and tension plate 16 being biased toward T-shaped locking bar 17 by biasing spring 15. Biasing spring 15 bears against one side 41 of a support 40 mounted on shaft 18 with one arm 34 of clevis 14 resting against an opposite side 42 of support 40 and other arm 35 of clevis 14 spaced from a hexagonal jam nut 13 contiguous with the underside 36 of T-shaped handle 11, jam nut 13 firmly affixing T-shaped handle 11 to one end 27 of shaft 18. Mooring device 10 is constructed in a manner such that mooring device 10 may be utilized with any dock 50 by having locking bar 17 disposed at a distance from tension plate 16 corresponding to a minimum thickness of dock boards 54 generally utilized in the construction of docks. It is to be fully understood that dock boards 54 are generally of common two by four lumber construction having a thickness of one and one-half inches with a spacing between adjacent dock boards of three eighths of an inch as specified in standards established for watercraft docks.

T-handle 11 is a plastic or metallic handle used for compressing spring 15 engaging tension plate 16 against an exposed surface 55 of adjacent dock boards 54 and for turning locking bar 17 into position on opposite surface 56 of dock boards 54. T-handle 11 is threaded onto the terminal end 38 of threaded portion 37 of shaft 18 above hexagonal nut 13 which has been previously threaded onto threaded portion 37 of shalt 18. Hexagonal nut 13 acts as a jam nut, locking T-handle 11 onto shaft 18. Spaced from the underside 39 of nut 13 is an anchor shackle clevis 14 to which is attached a lanyard 30. Support 40, generally a roll pin 19, but which could also be a C-ring in another groove on shaft 18 or a swaging about the shaft 18, between one arm 34 of anchor clevis 14 and spring 15 retains anchor clevis 14 in a freely rotating position between nut 13 and spring 15 while providing the upward support 40 of spring 15. The lower end 43 of spring 15 bears against the upper surface 113 of locking means 20 disposed upon shaft 18 with the lower surface 114 of locking means 20 bearing against the upper surface 44 of tension plate 16. When mooring device 10 is in a free state, another roll pin 19' may support tension plate 16 at a minimum distance from locking bar 17, the minimum distance being less than the minimum thickness of dock boards 54. When T-handle 11 is depressed, after inserting locking bar 17 through slot 29 between adjacent dock boards 54 and engaging tension plate 16 against exposed surface 55 of dock boards 54, support 40 bears against the upper end 45 of spring 15 forcing spring 15 to firmly engage locking means 20 and, in ram, tension plate 16 against exposed surface 55 of dock boards 54. When locking bar 17 has been moved into a position beneath opposite surface 56 of dock boards 54, T-handle 11 is turned an angular amount, preferably approximately ninety degrees, sufficient to place locking bar 17 in engagement with opposite surface 56 of dock boards 54. T-handle 11 is then released causing locking bar 17 to firmly engage underside of dock boards 54 capturing dock boards 54 between locking bar 17 and tension plate 16.

Locking bar 17 is formed from a rigid material such as steel and is generally cylindrical in shape with terminal ends 46. Each of terminal ends 46 may be burnished in a half-spherical shape or cut square perpendicular to an axis 47 through locking bar 17. Each of square cut terminal ends may further have a chamfer cut upon its outer periphery. Shaft 18 is formed as an elongated cylindrical bar and has a threaded portion 37 formed on one end 27 thereof. Shaft 18 may have a double cusp formed on the other end 28 thereof to accept cylindrical locking bar 17 therein. Locking bar 17 is then rigidly affixed to shaft 18 by a fillet weld around the outline of the double cusp. Alternately, locking bar 17 may be abutted against a square end 65 of shaft 18 and fillet welded to shaft 18 by filling the spaces created by the juncture of the square end 65 of shaft 18 and the upper rounded surface 25 of locking bar 17.

In order to establish the position of tension plate 16, a first hole 48 is formed through shaft 18 at a distance spaced from the upper surface 25 of locking bar 17 corresponding to a distance less than the minimum thickness of dock boards 54. When used, roll pin 19' is then driven through first hole 48 having its ends 49 extend equally on opposite sides of shaft 18. A common one-eighth diameter roll pin is preferably utilized as roll pin 19' and may be purchased from local hardware stores.

Tension plate 16 is formed as a flat disc having a central hole 57 substantially equal in diameter to the diameter of shaft 18. Tension plate 16 may have an outer periphery 58 of any shape with the distance between opposite edges 59 substantially larger than distance between dock boards 54. In this preferred embodiment, tension plate 16 is generally circular having a distance of about two and three quarters inches between opposite edges 59 corresponding to the diameter of tension plate 16. Tension plate 16 may be purchased from local farm supply houses as an one eighth inch thick, 2.75 inch diameter washer with a 0.375 inch diameter through bore or may be manufactured from one eighth inch thick rolled plate. Tension plate 16 is disposed on shaft 18 and may rest on roll pin 19' in first hole 48.

Figure 3:
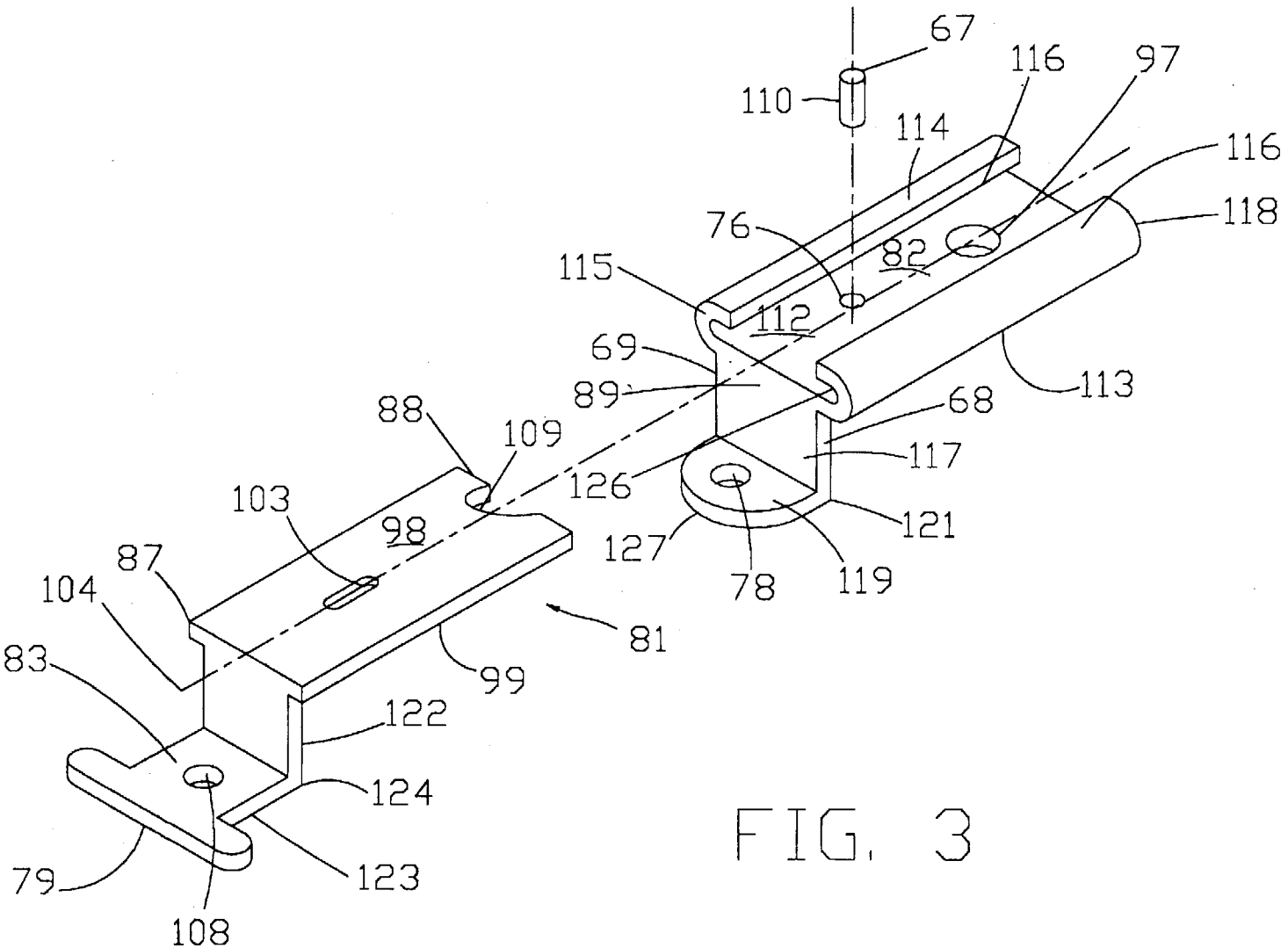
FIG. 3 is an exploded perspective view of the preferred embodiment of the locking assembly utilized with the mooring device.

Referring now to FIGS. 2 and 3, locking means 20 comprises a channel shaped top plate 21 having inwardly turned channel walls 116 defining a slot 82 on bottom surface 112 of top plate 21. Inwardly turned channel walls 116 have a lower surface 114 parallel to upper surface 113 of top plate 21. Slot 82 generally extends the entire length of top plate 21 but may, of course, be enclosed on the free end 118 thereof. A locking slide 81 is slidably disposed in slot 82 and further has a padlock means 83 associated therewith to cooperate with cooperating padlock means 84 of top plate 21. Shaft 18 has a circumferential groove 90 formed therearound for receiving the concave recess 109 of locking slide 81 therein and when locking slide: 81 is fully engaged within groove 90, cooperating padlock means 84 of top plate 21 is aligned with padlock means 83 in locking slide 81. Mooring device 10 may then be lockably secured to dock 50 by inserting a padlock in the aligned padlock means 83 and 84 and closing the hasp of the padlock. For instance, for a standard dock board thickness of one and one-half inches, groove 90 is formed around shaft 18 with closest edge 91 spaced from upper surface 25 of locking T-bar 17 a distance equal to the thickness of inwardly turned channel walls 116 plus the thickness of tension plate 16 plus one and one-half inches.

Top plate 21 is generally rectangular and has a hole 97 formed therethrough having common center line 96 spaced inwardly of free end 118 at least a distance equal to half the diameter of shaft 18. Top plate 21 has a slide retaining pin 110 disposed in a blind hole 76 formed into the bottom surface 112 thereof which is adapted to ride in a slot 103 formed in locking slide 81. Slide retaining pin 110 is approximately centrally located in slot 82 between inwardly mined channel walls 116 and is spaced inwardly of one end 115 of top plate 21 a distance sufficient to be inaccessible from one end 115 when locking means 20 is fully assembled and disposed upon shaft 18. Cooperating padlock means 84 on top plate 21 comprises an upright flange 117 having an ear 119 attached to the upper surface 121 thereof, ear 119 having a padlock hole 78 disposed therein. Ear 119 is generally parallel to surfaces 113 and 114.

Locking slide 81 is generally rectangular and formed from a length of flat metallic stock with a width equal to or less than the width of the slot 82 formed between the upright portions 126 of inwardly mined channel walls 116 of top plate 21. End 87 of locking slide 81 overlies end 115 of top plate 21 and extends beyond the end 89 of slot 82. In a manner similar to top plate 21, locking slide 81 has an upright portion 122 on end 87 thereof which also has an ear 123 attached to an upper surface 124. Ear 123 has a padlock hole 108 disposed therethrough and further has a T-shaped terminal end 79 adapted for moving locking slide 81 within slot 82. The thickness of locking slide 81 is approximately the same as the depth of slot 82. Locking slide 81 has a semi-circular concave recess 109 formed in end 88 having a radius smaller than the radius of shaft 18 and approximately equal to the radius of groove 90. Locking slide 81 has a slot 103 formed through its parallel surfaces 98, 99 adapted to receive retaining pin 110 therethrough when locking means 20 is fully assembled.

Prior to disposing upon shaft 18, locking slide 81 is disposed in slot 82 with retaining pin 110 being driven into blind hole 76 in top plate 21 such that the free end 67 of retaining pin 110 is flush with bottom surface 98 of locking slide 81. Thus, locking slide 81 may not be removed from top plate, 21 after retaining pin 110 is force fired into blind hole 76. After assembly, locking means 20 is disposed upon shaft 18 with lower surface 114 contiguous with and resting upon upper surface 44 of tension plate 16.

Figure 5:
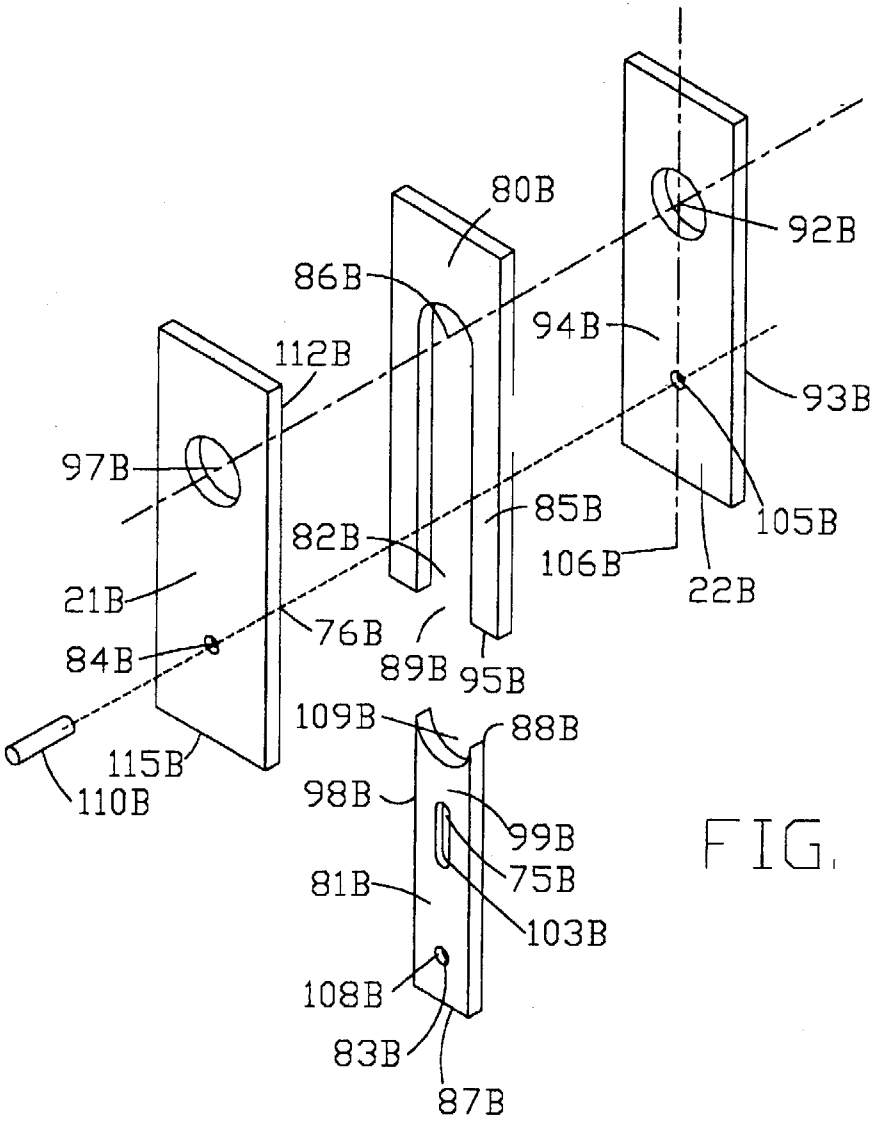
FIG. 5 is an exploded perspective view of an alternate embodiment of a lockable mounting plate assembly utilized with the mooring device.

In an alternate embodiment shown in FIG. 5, locking means 20B may be constructed of three plates, bottom plate 22B, a central spacer plate 80B and a top plate 21B. Slot 82B is defined between top plate 21B and bottom plate 22B and is adapted to receive locking slide 81B slidably disposed therein. Locking slide 81B further has a padlock means 83B associated therewith as does top plate 21B. Cooperating padlock means 84B of top plate 21B is aligned with padlock means 83B of locking slide 81B when locking slide 81B is fully engaged within a groove 90B circumferentially formed around shaft 18B. For instance, for a standard dock board thickness of one and five eighths inches, groove 90B is formed around shaft 18B with closest edge 91B spaced from upper surface 25B of locking T-bar 17B a distance equal to the thickness of bottom plate 22B plus the thickness of tension plate 16B plus one and one half inches.

Bottom plate 22B is generally rectangular and formed from flat rigid material having a centrally disposed hole 92B formed front bottom surface 93B through top surface 94B and is adapted to stackably receive central spacer plate 80B. Central spacer plate 80B is also generally rectangular and is approximately the same shape and size as bottom plate 22B except central spacer plate 80B has a U-shaped slot 82B formed therein from one edge 95B extending at least one half the diameter of shaft 18B beyond a center line 96B. Center line 96B is common to bottom plate 22B, central spacer plate 80B, top plate 21B and shaft 18B and is adapted to concentrically align with centrally disposed hole 92B in bottom plate 22B and a hole 97B disposed in top plate 21B wherein these holes are adapted to receive shaft 18B therethrough.

Top plate 21B is also rectangular and formed from flat rigid material and has hole 97B formed therethrough. Top plate 21B has a slide retaining pin 110B disposed on the bottom surface 112B thereof which is adapted to ride in a slot 103B formed in locking slide 81B or abut a retainer 111B disposed on locking slide 81B. Slide retaining pin 110B is spaced inwardly of one edge 95B of spacer plate 80B a distance sufficient to be inaccessible from one edge 95B when locking means 20B is fully assembled. Top plate 21B is stackably received on an upper surface 85B of central spacer plate 80B which has been stackably received upon the upper surface 94B of bottom plate 22B.

Locking means 20B is then formed into an integral unit by affixing all three plates 21B, 22B and 80B together by welding the edges together or by screwing the plates together from the bottom surface 93B of bottom plate 22B. Prior to affixing the plates 21B, 22B and 80B together, locking slide 81B is disposed in slot 82B with retaining pin 110B disposed into slot 103B. After assembly, locking means 20B is disposed upon shaft 18B with lower surface 114B contiguous with and resting upon upper surface 44B of tension plate 16B. Center spacer plate 80B and top plate 21B may be made such that an end 115B of top plate 21B overlies bottom plate 22B and the outer periphery 58B of tension plate 16B, end 115B having cooperating means 84B disposed therein aligning with padlock means 83B disposed in locking slide 81B. In this manner, a padlock may be engaged in padlock means 83B and cooperating means 84B such that the locking loop of the padlock may be inserted into the space 29B between adjacent dock boards 54B.

In another alternate embodiment, the locking means is rigidly affixed to the upper surface of the tension plate by welding around the outer periphery of the bottom plate while being held in contact with the tension plate. The bottom plate may also be affixed to the tension plate by inserting machine screws through the tension plate into threaded holes in the bottom surface of the bottom plate. Of course, the locking means may be assembled onto the tension plate in a similar manner by inserting machine screws through the tension plate, the bottom plate, the central spacer plate and into the top plate. When assembling the locking means to the tension plate in this manner, the slide retaining pin disposed on the bottom surface of the top plate must be aligned in the slot formed in the locking slide or abut the retainer disposed on the locking slide.

In still another alternate embodiment, the locking means is made integral with the tension plate by utilizing the tension plate as the bottom plate. The locking means thus comprises a tension plate, a central spacer plate having a locking slide slidably disposed in a slot formed therein and a top plate. The locking slide further has a padlock means associated therewith as does the top plate. A cooperating padlock means of the top plate is aligned with the padlock means of the locking slide when the locking slide is fully engaged within a groove circumferentially formed around the shaft. Locking means may be assembled onto the tension plate by inserting machine screws through the tension plate, the central spacer plate and into the top plate. When assembling a locking means to the tension plate in this manner, the slide retaining pin disposed on the bottom surface of the top plate must be aligned in the slot formed in the locking slide or abut the retainer disposed on locking slide.

In alternate locking means 20B of FIG. 5, tension plate 16B, center spacer plate 80B and top plate 21B may be of any shape but are generally rectangular. Of course, tension plate 16B may be circular while center spacer plate 80B and top plate 21B may be rectangular with an end 115B overlying the outer periphery outer periphery 58B of tension plate 16B wherein end 115B has cooperating means 84B disposed therein aligning with padlock means 83B disposed in locking slide 81B. In this manner, a padlock may be engaged in padlock means 83B and cooperating means 84B such that the locking loop of the padlock may be inserted into the space 29B between adjacent dock boards 54B.

Spring 15, described here in conjunction with FIG. 2 and FIG. 4, is preferably formed from spring wire into an helical coil having an inside diameter substantially equal to outside diameter of shaft 18. Spring 15 preferably has machine ground square ends 43 and 45 for positive engagement with upper surface 113 of locking means 20 and support 40, generally a roll pin 19, but which could also be a C-ring in another groove on shall 18 or a swaging about the shaft 18, is disposed in a second hole 60 in shaft 18. Second hole 60 is preferably spaced above first hole 48 a distance substantially equal to the free length of spring 15 such that upon assembly onto shall 18, spring 15 is under a slight compression due to the thickness of tension plate 16. Roll pin 19 in second hole 60 also has its ends 49 extend equally on opposite sides of shaft 18. Spring 15 is then disposed upon shall 18 resting upon upper surface 113 of locking means 20. Spring 15 is then slightly depressed and roll pin 19 is driven through second hole 60 capturing spring 15 between roll pin 19 and upper surface 113 of locking means 20.

Anchor shackle clevis 14 is formed into a U-shape having parallel arms 34 and 35 wherein each arm 34, 35 has a hole 61 formed therein perpendicular to the respective parallel arm 34, 35. Hole 61 in each of parallel arms 34, 35 is substantially equal in diameter to outside diameter of shaft 18. Clevis 14 is disposed upon shaft 18 by passing shaft 18 through holes 61 in parallel arms 34, 35. Clevis 14 then rests upon roll pin 19 in second hole 60 with the U-shaped bight 62 of clevis 14 extending perpendicular to axis 66 of shaft 18. Clevis 14 has both parallel arms 34, 35 disposed upon smooth outer periphery of shaft 18 and is spaced away from nut 13 such that clevis 14 is free to rotate upon shaft 18. Anchor shackle clevis 14 may be purchased from local farm supply houses or hardware stores.

Threaded portion 37 of shaft 18 extends from terminal end 38 of shaft 18 at least a distance equal to thickness of nut 13 and the internal threaded length of T-handle 11. Nut 13 is disposed upon shaft 18 to substantially the full length of threaded portion 37. Nut 13 is preferably a common three eighths standard hexagonal (⅜UNC18) nut having eighteen threads per inch.

T-handle 11 is formed from a suitable material and preferably is approximately three and one half inches in length with a breadth of one and six tenths inches. T-handle 11 is approximately three quarters inch in thickness with a blind internal threaded hole 63 disposed in the undersurface 36 thereof. Blind hole 63 has a three eighths standard thread (⅜UNC18) corresponding to threaded portion of shaft 18. T-handle 11 may be machined, east or drop forged from metallic material such as brass, bronze, aluminum, iron or steel. Preferably, however, T-handle 11 is molded of a rigid thermoplastic around an internally threaded metallic insert thereby constituting blind threaded hole 63. T-handle 11 is most preferably molded of a phenolic resin thermoplastic commonly used for handles but may also be molded of any one or a combination of polypropylene, polyethylene, polyamide, polyparabenzamide, fiberglas, polytetrafluoroethylene or the like. Additionally, the above thermoplastic material may contain reinforcing fibers such as fiberglas, carbon fiber or steel wires. To complete the assembly of mooring device 10, T-handle 11 is threaded upon terminal end 38 of threaded portion 37 of shaft 18. Nut 13 is then tightened against underside 36 of T-handle 11 locking same upon shaft 18.

Prior to use as a mooring device, the owner thereof may elect to secure a lanyard 30 of rope 12, chain or steel cable or combinations of the above to U-shaped bight 62 of clevis 14 depending upon the intended use of mooring device 10. For instance, if the owner desires to utilize mooring device 10 as a temporary mooring device, a lanyard 30, such as rope 12 having an eye 32 in the open end 33 is secured to bight 62 of clevis 14. Rope 12 will suffice for temporary mooring as eye 32 may be temporarily secured to a cleat 101 on the gunwale 102 of watercraft 100 while mooring device 10 is inserted between adjacent dock boards 54 and secured thereto by locking the locking slide 81 to cooperating locking means 84. Similarly, if the owner desires to utilize mooring device 10 as a semi-permanent mooring device, lanyard 30 should comprise a chain having a link on one end thereof placed within U-shaped bight 62 upon assembly of mooring device 10 and the other end secured to a lifting eye 71 or towing eye 72 of watercraft 100.

A method of manufacturing locking means 20 is now described. Locking means comprises a top plate 21 having a locking slide 81 slidably disposed in a slot 82 formed therein. Top plate 21 is generally rectangular and stamped into a shallow U-shaped channel from cold rolled, hot rolled or stainless steel plate. A tab portion 125 is first formed as a flat tab having edges 68 and 69 and a rounded end 127 sheared during the stamping operation. A hole 97 approximately three eighths inches in diameter, centered on a center line 96, is punched through top plate 21 from lower surface 112 through upper surface 113 to slidably receive shaft 18 therein. Similarly, padlock hole 78 is punched through top plate 21 in rounded end 127 of tab portion 125 approximately three eighths of an inch from terminal rounded end 127. Hole 97 is located approximately centrally in the narrow direction but approximately one and one quarter inch from end 118. Inwardly mined walls 116, approximately two and one half inches long of channel portion 128 are formed from the legs of the channel by rolling a portion of the leg inwardly upon completion of the stamping operation. Channel portion 128 is approximately one and one half inches wide having rectangular ends 118 and 115. Upright flange 117 is then formed by bending tab portion 125 away from channel portion 128 at end 115. An ear 119 is formed parallel to channel portion 128 by bending a portion of tab 125 at a right angle to upright flange 117 at upper surface 121. The square corners and edges of top plate 21 may be burnished or broken with a file or a group of parts may be tumbled together with a suitable abrasive to remove the rough edges. Top plate 21 has a blind hole 76 drilled on a center line 104 perpendicularly intersecting center line 96 and being spaced approximately one inch from center line 96. Blind hole 76 is preferably approximately one eighth inch in diameter and is blind drilled into bottom plate 22 approximately one quarter inch. Blind hole 76 is adapted to receive retaining pin 110 therein when locking means 20 is fully assembled.

Locking slide 81 is generally rectangular but is longer than slot 82 such that end 87 overlies and extends beyond the end 115 of slot 82 in top plate 21. Locking slide 81 is stamped from flat rigid material such as cold rolled, hot rolled or stainless steel plate. A T-shaped end 79 is formed on one end of locking slide 81 by shearing away a narrow strip of material from each edge of a rectangle of material while simultaneously punching hole 108 in T-shaped end 79, slot 103 in slide portion 74, and concave recess 109 in opposite end 88. The thickness of locking slide 81 is approximately the same as the depth of slot 82. Semi-circular concave recess 109 has a radius of approximately five thirty seconds (5/32) of an inch for receiving groove 90 of shaft 18 therein. Hole 108 constitutes padlock means 83 and is located in T-shaped end 79 to align with padlock hole 78 in upper plate 21. The square comers and edges of locking slide 81 may also be burnished or broken with a file. Slot 103 is approximately three sixteenths of an inch wide and approximately three quarters of an inch in length having its first end 75 spaced from center line 96 approximately one half inch. Slot 103 receives retaining pin 110 therethrough when locking means 20 is fully assembled. In this manner, retaining pin 110 extends from lower surface 112 only to the upper surface 99 of locking slide 81.

In order to assemble locking means 20, locking slide 81 is placed in slot 82 with slot 103 aligned with hole 76 in top plate 21. Retaining pin 110 is driven into hole 76 and extends through to surface 98 of locking slide 81. After assembly, locking means 20 is disposed upon shaft 18 with lower surface 114 contiguous with and resting upon upper surface 44 of tension plate 16. Upon assembly of locking means 20, top plate 21 has terminal end 127 overlying the outer periphery 58 of tension plate 16 and has cooperating means 84 aligned with padlock means 83 disposed in locking slide 81 when locking slide 81 is fully engaged within groove 90 circumferentially formed around shaft 18. Upon completion of assembly of locking means 20 when locking means 20 has been constructed of cold robbed or hot robbed plate, locking means 20 is preferably plated with a rust inhibiting plating material commonly used in the industry.

In the first alternate embodiment shown in FIG. 5, locking means comprises a bottom plate 22B, a central spacer plate 80B having a locking slide 81B slidably disposed in a slot 82B formed therein and a top plate 21B. Bottom plate 22B is generally rectangular and cut from flat rigid material such as cold rolled, hot rolled or stainless steel plate by flame cutting, sawing or milling the rectangular edges approximately two and one half inches long by one and one half inches wide. A hole 92B approximately three eighths inches in diameter is drilled or milled through bottom plate 22B from bottom surface 93B through top surface 94B and adapted to slidably receive shaft 18B therein. Hole 92B is located approximately centrally in the narrow direction but approximately one and one quarter inch from one end of the long direction in bottom plate 22B. The square corners and edges of bottom plate 22B may be burnished or broken with a file. Bottom plate 22B has a second smaller hole 105B drilled on a center line 106B perpendicularly intersecting center line 96B and being spaced approximately one inch from center line 96B. Smaller hole 105B is preferably approximately one eighth inch in diameter and is blind drilled into bottom plate 22B approximately one quarter inch. Smaller hole 105B is adapted to receive retaining pin 110B therein when locking means 20B is fully assembled.

Central spacer plate 80B is also generally rectangular and is approximately the same shape and size as bottom plate 22B. Central spacer plate 80B is cut from flat rigid material such as cold rolled, hot robed or stainless steel plate by flame cutting, sawing or milling the rectangular edges approximately two and one half inches long by one and one half inches wide. The square comers and edges of central spacer plate 80B may also be burnished or broken with a file. Central spacer plate 80B has a U-shaped slot 82B milled therein from one edge 95B extending at least one half the diameter of shaft 18B beyond center line 96B. U-shaped slot 82B is approximately three quarters of an inch in width with a terminating bight 86B having a radius of approximately three sixteenths of an inch. Center line 96B concentrically aligns with hole 92B in bottom plate 22B and hole 97B in top plate 21B for receiving shaft 18B therethrough.

Locking slide 81B is generally rectangular but is longer than slot 82B such that end 87B overlies bottom plate 22B and extends beyond the end 89B of slot 82B in central spacer plate 80B. Locking slide 81B is cut from flat rigid material such as cold rolled, hot rolled or stainless steel plate by flame cutting, sawing or milling the rectangular edges. The thickness of locking slide 81B is approximately the same as the thickness of central spacer plate 80B. Locking slide 81B has a semi-circular concave recess 109B having a radius of approximately five thirty seconds (5/32) of an inch machined in its opposite end 88B for receiving groove 90 of shaft 18 therein and has padlock means 83B comprising a hole 108B drilled through end 87B for receiving a padlock therein. The square comers and edges of locking slide 81B may also be burnished or broken with a file. Locking slide 81 has a slot 103B formed through its parallel surfaces approximately three sixteenths of an inch wide and a length of approximately three quarters of an inch having its first end 75B spaced from center line 96 approximately one half inch. Slot 103B receives retaining pin 110B therethrough when locking means 20B is fully assembled. Alternately a retainer (not shown) may be affixed to locking slide 81B which extends upwardly toward lower surface 112B of top plate 21B and aligns with retaining pin 110B along center line 106B. In this manner, retaining pin 110B extends from lower surface 112B only to the upper surface 99B of locking slide 81B.

Top plate 21B is also rectangular but is longer in one direction than bottom plate 22B or central spacer plate 80B and is cut from flat rigid material such as cold rolled, hot rolled or stainless steel plate by flame cutting, sawing or milling the rectangular edges into a generally rectangular shape approximately one and one half inches wide by three inches long. The square comers and edges of top plate 21B are burnished or broken with a file. Top plate 21B has a hole 97B machined through approximately three eighths of an inch in diameter and spaced from one end 115B approximately two and one quarter inch. Hole 97B aligns with hole 92B and center line 96B for receiving shaft 18 therethrough. Top plate 21B has slide retaining pin 110B press fitted into a hole 76B drilled into bottom surface 112B and aligns with slot 103B formed in locking slide 81B. Slide retaining pin 110B is spaced from center line 96 approximately three quarters of an inch and protrudes from bottom surface 112B not more than one quarter inch more than the thickness of locking slide 81B.

In order to assemble locking means 20B, top plate 21B is stackably received on an upper surface 85B of central spacer plate 80B which has been stackably received upon the upper surface 94B of bottom plate 22B. Locking slide 81B is placed in slot 82B with retaining pin 110B extending through slot 103B into hole 105B. Locking means 20B is becomes an integral unit by welding all three plates 21 B, 22B and 80B. Alternately, machine screw holes may be match drilled through plates 21B and 80B and into top plate 21B with the holes in top plate 21B being threaded for receiving machine screws therein. Locking means 20B then becomes an integral unit by screwing the plates together from the bottom surface 93B of bottom plate 22B. After assembly, locking means 20B is disposed upon shaft 18 with lower surface 114B contiguous with and resting upon upper surface 44 of tension plate 16. Upon assembly of locking means 20B, top plate 21B has end 115B overlying bottom plate 22B and the outer periphery 58B of tension plate 16 and has cooperating means 84B aligned with padlock means 83B disposed in locking slide 81B when locking slide 81B is fully engaged within groove 90B circumferentially formed around shaft 18. In this manner, a padlock may be engaged in padlock means 83B and cooperating means 84B such that the locking loop of the padlock may be inserted into space 29 between adjacent dock boards 54. Upon completion of assembly of locking means 20B when locking means 20B has been constructed of cold rolled or hot rolled plate, locking means 20B is preferably plated with a rust inhibiting plating material commonly used in the industry.

In another alternate embodiment not shown, a locking means is manufactured as described above and is then rigidly affixed to the upper surface of the tension plate by welding around the outer periphery of the bottom plate while the bottom plate is held in contact with the tension plate. Of course, the bottom plate may also be affixed to the tension plate by inserting machine screws through the tension plate into threaded holes in the bottom surface of the bottom plate or the locking means may be assembled onto the tension plate in a similar manner by inserting machine screws through the tension plate, the bottom plate, the central spacer plate and into the top plate. When assembling the locking means to the tension plate in this manner, the slide retaining pin disposed on the bottom surface of the top plate must be aligned in the slot formed in the locking slide.

In another alternate embodiment not shown, a locking means is manufactured integral with the tension plate by utilizing the tension plate as the bottom plate. The locking means thus comprises the tension plate, the central spacer plate having the locking slide slidably disposed in the slot formed therein and the top plate. The locking slide further has a padlock means formed as described above and the top plate has the cooperating padlock means aligned therewith when the locking slide is fully engaged within a groove circumferentially formed around the shaft. The locking means may be assembled onto the tension plate by inserting machine screws through the tension plate, the central spacer plate and into the top plate. When assembling the locking means to the tension plate in this manner, the slide retaining pin disposed on the bottom surface of the top plate must be aligned in the slot formed in the locking slide.

Locking means 20 of this invention may be utilized to in combination with the mooring device of U.S. Pat. No. 4,297,963 for lockably securing the mooring device to a docking platform by placing locking means 20 immediately above the plate and below the first washer shown in the aforementioned patent. The shaft of the mooring device of U.S. Pat. No. 4,297,963 must be first modified by forming a circumferential groove such as groove 90 with the closest edge spaced from the upper surface of the head a distance equal to the thickness of the plate plus the thickness of the bottom plate plus the thickness of the dock boards. Once the groove is formed into the shaft of the mooring device of U.S. Pat. No. 4,297,963 and locking means 20 is disposed thereon, completion of the assembly of the mooring device proceeds as described in the aforementioned patent.

Similarly, locking means 20 of this invention may be utilized to in combination with the Portable Docking Ring, Item 20-583-863-00, available from Bass Pro Shops, Springfield Mo. as shown in Bass Pro Shops 1996 Marine catalog, page 80, by plating locking means 20 immediately above bent wire bar and below the mooring ring shown in the catalog. The shaft of the portable docking ring must be first modified by forming a circumferential groove such as groove 90 with closest edge spaced from the upper surface of the bent wire bar a distance equal to the thickness of the dock boards. Once the groove is formed into the shaft of the portable docking ring and locking means 20 is disposed thereon, the docking loop may be bent as shown in the catalog.

In an alternate embodiment as shown in FIG. 4, locking means 20A comprises at least one hole 120A drilled through shaft 18A adapted to receive a pad lock therein. Multiple holes 120A may be formed through shaft 18A at locations commensurate with the thickness of various dock boards 54 such that mooring device 10A may be utilized with any dock 50. For instance, for a standard dock board thickness of one and five eighths inches, the center of hole 120 would be spaced from the upper surface 25A of locking T-bar 17A a distance equal to one half the diameter of hole 120 plus the thickness of tension plate 16A plus one and one half inches. With spikes 26A on locking bar 17A disposed into opposite surface 56 of dock boards 54 and a pad lock in hole 120A corresponding to the thickness of dock boards 54, a secure mooring of watercraft 100 is accomplished. In this manner, mooring device 10A may not be removed from engagement with dock boards 54 as it will not rotate in either direction until the padlock is removed and shaft 18A is depressed against the pressure of spring 15A disengaging spikes 26A from opposite surface 56 of dock boards 54. Similarly, tension plate 16A may have spike like projections on the underside 64A thereof which are adapted to bite into the uppermost surface 55 of dock boards 54. The construction of alternate mooring device 10A of FIG. 4 is otherwise similar to the construction and operation of mooring device 10 of the preferred embodiment and a recitation of the details thereof is unnecessary.

It is readily apparent from a reading of this description and viewing of the drawings that the integrity of a mooring utilizing locking means 20 may not be breached by rotating locking means about shaft 18 as locking; slide 81 remains lockably engaged in groove 90 until the padlock is removed from padlock means 83 and cooperating locking means 84 and locking slide is moved from engagement with groove 90.

While the forms and methods of this invention now preferred have been illustrated and described as required by the Patent Statute, it is to be understood that other forms and methods can be utilized and still fall within the scope of the appended claims.

I claim:

1. In a mooring device adapted for mooring a craft to a docking platform having spaced decking elements of uniform thickness, the mooring device having a means for securing a line thereto and comprising a body in rigid T-bar form having a shaft and an elongated head secured transversely to one end thereof wherein the head is sufficiently narrow to fit between the decking elements, the shaft further having a flat plate mounted thereon for slideable movement toward and away from the head with a biasing means associated with the plate to urge the head toward the plate, the improvement wherein said mooring device has locking means associated therewith for lockably securing said mooring device to said docking platform.

2. A mooring device as described in claim 1 wherein said locking means is associated with said plate of said mooring device.

3. A mooring device as described in claim 2 wherein said shaft has a circumferential groove disposed therearound adapted to cooperate with said locking means.

4. A mooring device as described in claim 3 wherein said locking means is integral with and carried by said flat plate of said mooring device.

5. A mooring device as described in claim 4 wherein said flat plate having said locking means integral therewith is adapted to rotate about said shaft of said mooring device.

6. A mooring device as described in claim 5 wherein said locking means comprises a slot in said flat plate having a locking slide disposed therein said locking slide adapted to slide toward and away from said shaft.

7. A mooring device as described in claim 6 wherein said locking slide has a hole disposed therethrough adapted to align with a mating hole in said flat plate for receiving a padlock therein.

8. A mooring device as described in claim 7 wherein said locking slide has a semi-circular recess in an end adjacent to said shaft for partially encircling said circumferential groove in said shaft.

9. A mooring device as described in claim 3 wherein said locking means is initially separate from said mooring device.

10. A mooring device as described in claim 9 wherein said locking means is contiguous with and independent of said flat plate and carded by said shaft of said mooring device.

11. A mooring device as described in claim 10 wherein said locking means is adapted to rotate about said shaft of said mooring device independently of said flat plate.

12. A mooring device as described in claim 11 wherein said locking means comprises a slot in said flat plate having a locking slide disposed therein said locking slide is adapted to slide toward and away from said shaft.

13. A mooring device as described in claim 12 wherein said locking slide has a hole disposed therethrough adapted to align with a mating hole in said flat plate for receiving a padlock therein.

14. A mooring device as described in claim 12 wherein said locking slide has a semi-circular recess in an end adjacent to said shaft for partially encircling said circumferential groove in said shaft.

15. A mooring device as described in claim 3 wherein said locking means is attached to and carried by said flat plate of said mooring device.

16. A mooring device as described in claim 15 wherein said locking means is adapted to rotate about said shaft of said mooring device with said flat plate.

17. A mooring device as described in claim 16 wherein said locking means comprises a slot in said flat plate having a locking slide disposed therein said locking slide is adapted to slide toward and away from said shaft.

18. A mooring device as described in claim 17 wherein said locking slide has a hole disposed therethrough adapted to align with a mating hole in said flat plate for receiving a padlock therein.

19. A mooring device as described in claim 17 wherein said locking slide has a semi-circular recess in an end adjacent to said shaft for partially encircling said circumferential groove in said shaft.

20. In a mooring device adapted for mooring a craft to a docking platform having spaced decking elements of uniform thickness, the mooring device having a means for securing a line thereto and comprising having a shaft and an elongated head secured transversely to one end thereof wherein the head is sufficiently narrow to fit between the decking elements, the improvement wherein said mooring device has locking means integral therewith and carried upon said shall for lockably attaching said mooring device to said docking platform.

* * * * *